US005645087A

United States Patent [19]

Chehab et al.

[11] Patent Number: 5,645,087

[45] Date of Patent: Jul. 8, 1997

[54] METHOD OF AND APPARATUS FOR DECONTAMINATING THE EXPOSED SURFACES OF FILTER MOUTHPIECES IN SMOKERS' PRODUCTS

[75] Inventors: Firdausia Chehab, Hamburg; Stefan Fietkau, Westerau; Peter-Franz Arnold; Thomas Juschus, both of Hamburg; Clemens Schmick, Geesthacht, all of Germany

[73] Assignee: Hauni Maschinenbau AG, Hamburg, Germany

[21] Appl. No.: 618,965

[22] Filed: Mar. 20, 1996

[30] Foreign Application Priority Data

Apr. 5, 1995 [DE] Germany ..... 195 12 732.3

[51] Int. Cl.[6] ..... A24C 5/60

[52] U.S. Cl. ..... 131/88; 131/90; 131/79; 131/362; 131/94

[58] Field of Search ..... 131/95, 92, 281; 493/39, 45, 50, 340, 21, 22, 23, 24, 25, 26, 27, 28, 29, 30, 31, 32, 33, 1

[56] References Cited

U.S. PATENT DOCUMENTS 4,320,773 3/1982 Pinck et al. ..... 131/281

4,785,831 11/1988 Hinchcliffe et al. ..... 131/88

4,986,284 1/1991 Cahill et al. ..... 131/88

5,135,008 8/1992 Oesterling et al. ..... 131/94

*Primary Examiner*—V. Millin

*Assistant Examiner*—Charles W. Anderson

*Attorney, Agent, or Firm*—Darby & Darby

[57] ABSTRACT

Fragments of plastic fibers, such as cellulose acetate fibers, forming part of mouthpieces of filter cigarettes or like rod-shaped smokers' products tend to become separated from the respective filter mouthpieces at the end faces which develop in response to the making of cuts across filter rod sections of double unit length between pairs of plain cigarettes to obtain filter cigarettes of unit length. The fragments of fibers which tend to become separated and to contaminate the area around the filter cigarette making machine are either bonded (e.g., by heat and/or by a solvent) to the respective mouthpieces, or are removed by suction and/or by resorting to electrostatic precipitation. It is also contemplated to cause smoke-permeable layers of filter material to overlie the end faces of the mouthpieces.

5 Claims, 4 Drawing Sheets

METHOD OF AND APPARATUS FOR DECONTAMINATING THE EXPOSED SURFACES OF FILTER MOUTHPIECES IN SMOKERS' PRODUCTS

BACKGROUND OF THE INVENTION

The invention relates to the making of filter cigarettes, cigars or cigarillos (hereinafter simply called filter cigarettes) wherein rod-shaped mouthpieces containing fibrous filter material (such as cellulose acetate fibers) are joined end-to-end with rod-shaped components containing natural, reconstituted and/or artificial tobacco. More particularly, the invention relates to improvements in the making of filter cigarettes which are obtained by subdividing groups of aligned rod-shaped components including at least one filter rod section of unit length between two plain cigarettes, namely by severing the filter rod sections of successive groups midway between their ends to form pairs of filter cigarettes wherein the mouthpieces have exposed end faces likely to carry fragments of comminuted fibers which have a tendency to become separated from the respective mouthpieces and to contaminate the surrounding area. Such tendency exists in spite of partial bonding of neighboring fibers to each other by resorting to suitable plasticizers. Reference may be had, for example, to U.S. Pat. No. 3,974,007 granted Aug. 10, 1976 to Heinz Greve for "Method and apparatus for the production of filter rod sections or the like". The disclosure of this patent is incorporated herein by reference.

The atmosphere surrounding a filter cigarette making machine (e.g., a production line known as PROTOS 2 which is produced and distributed by the assignee of the present application) contains considerable quantities of fragmentized tobacco particles which can be gathered and reintroduced into cigarette making machines. This is not advisable if such atmosphere further contains fragments of fibrous filter material for tobacco smoke. Moreover, fragments of fibrous filter material at the end faces of filter mouthpieces forming pare of filter cigarettes detract from the appearance of such smokers' products. Still further, such fragments are likely to become separated from the filter mouthpieces during transport of filter cigarettes to and during manipulation in packing machines. Such undesirable uncontrolled separation of fibers and/or fragments of fibers is likely to occur irrespective of the exact nature of the fibrous material, i.e., not only if the filter mouthpieces contain cellulose acetate fibers.

OBJECTS OF THE INVENTION

An object of the invention is to provide a novel and improved method of decontaminating the end faces of mouthpieces forming part of filter cigarettes or analogous rod-shaped smokers' products.

Another object of the invention is to provide a method of preventing uncontrolled separation of fibers and/or fragments of fibers forming part of filter mouthpieces for tobacco smoke.

A further object of the invention is to provide a method of removing readily separable fibers and/or fragments of fibers from filter mouthpieces in a controlled and highly predictable manner.

An additional object of the invention is to provide a method of preventing the escape of fragments of fibers forming part of filter mouthpieces into the atmosphere surrounding machines for the making of filter cigarettes and like rod-shaped smokers' products.

Still another object of the invention is to provide a simple, reliable and inexpensive method of preventing uncontrolled or random separation of fibers and/or fragments of fibers of filter material from filter mouthpieces.

A further object of the invention is to provide a novel and improved method of enhancing the appearance of filter cigarettes and analogous smokers' products.

Another object of the invention is to provide an apparatus for the practice of the above outlined method.

An additional object of the invention is to provide a novel and improved apparatus which can prevent uncontrolled or random separation of fibers and/or fragments of fibers of filter material for tobacco smoke from filter cigarettes or analogous smokers' products and can be readily incorporated in or combined with existing filter cigarette making machines or production lines.

Still another object of the invention is to provide the apparatus with novel and improved means for severing filter rod-sections and for simultaneously performing additional important and desirable functions.

A further object of the invention is to provide an apparatus which contributes to the quality as well as to the appearance of filter cigarettes and analogous smokers' products.

SUMMARY OF THE INVENTION

One feature of the present invention resides in the provision of a method of processing smokers' products wherein a plurality of aligned rod-shaped components include at least one multiple-unit-length filter rod section containing plastic fibers (such as cellulose acetate fibers) and a pair of tobacco-containing components flanking the at least one section. The method comprises the steps of severing the products across their filter rod sections so that the severed sections develop or yield pairs of mouthpieces having end faces at which at least some of the fibers tend to become separated from the respective mouthpieces, and preventing uncontrolled separation of fibers from the respective mouthpieces.

The preventing step can include intentionally removing (i.e., removing on purpose) the at least some fibers from the respective mouthpieces. Such removing step can include pneumatically separating the at least some fibers from the respective mouthpieces. The pneumatic separation can involve reliance upon suction.

Alternatively, or in addition to the pneumatic separation, the removing step can include electrically separating the at least some fibers from the respective mouthpieces. For example, such separating step can include separating the at least some fibers from the respective mouthpieces by electrostatic precipitation.

The step of preventing uncontrolled separation of of fibers from the respective mouthpieces can also comprise securing the at least some fibers to the respective mouthpieces, and such securing step can include bonding the at least some fibers to the respective mouthpieces. For example, the bonding step can include fixing the at least some fibers to the respective mouthpieces with a solvent. Alternatively, or in addition, to the utilization of a solvent or the like, the securing step can include bonding the at least some fibers to the respective mouthpieces as a result of the application of heat, and such application of heat can involve heating the end faces of the mouthpieces. The application of heat can take place simultaneously with the severing step, i.e., the severing step can include torch cutting, flame cutting or analogous cutting (hereinafter referred to as torch cutting) the filter rod sections.

Still further, the step of preventing uncontrolled separation of at least some fibers from the respective mouthpieces can include applying to the end faces of the mouthpieces layers of a suitable filter material which is permeable to tobacco smoke. For example, such layers can constitute bottom end walls of substantially cup-shaped bodies which are caused to confine portions of or entire mouthpieces to thus prevent unintentional separation of at least some (e.g., fragmentized) fibers from such mouthpieces.

Another feature of the present invention resides in the provision of an apparatus for processing smokers' products of the type wherein a plurality of aligned rod-shaped components include at least one multiple-unit-length filter rod section containing plastic fibers (such as cellulose acetate fibers) and a pair of tobacco-containing components fanking the at least one section. The improved apparatus comprises means for severing the products across their filter rod sections so that the severed sections develop or yield pairs of mouthpieces having end faces at which at least some of the fibers tend to become separated from the respective mouthpieces, and means for enhancing the quality of the end faces, particularly by preventing unocontrolled or random separation of at least some fibers from the respective mouthpieces. As a rule, at least some of the fibers in the mouthpieces are comminuted by the severing means.

The means for preventing uncontrolled separation of at least some fibers from the mouthpieces can comprise a rotary conveyor (e.g., a rotary drum-shaped or wheel-shaped conveyor having axially parallel peripheral flutes for severed products) and means for intentionally removing the at least some fibers from the respective mouthpieces on the conveyor. The removing means can include means for pneumatically removing the at least some fibers from the respective mouthpieces, and such removing means can include suction chambers arranged to be positioned adjacent the end faces of the mouthpieces and means for evacuating air and the at least some fibers from the thus positioned suction chambers.

In addition to or in lieu of pneumatically effecting controlled separation of at least some fibers from the respective mouthpieces, the quality enhancing means can comprise means for establishing electric fields adjacent the end faces of the mouthpieces.

Still further, the quality enhancing means can comprise means for securing the at least some fibers to the respective mouthpieces, preferably while the mouthpieces are carried by the aforementioned rotary conveyor. Such securing means can comprise means for directing droplets of a suitable liquid or liquefied solvent against the end faces of the mouthpieces. In addition to or in lieu of a solvent, the securing means can comprise at least one source of heat, and such source of heat can form part of the severing means. For example, the severing means can comprise at least one laser.

The quality enhancing means can also comprise filters for tobacco smoke which are caused to overlie at least the end faces of the mouthpieces so as to prevent uncontrolled separation of fragmentized and/or other fibers from the respective mouthpieces.

The novel features which are considered as characteristic of the invention are set forth in particular in the appended claims. The improved method and apparatus themselves, however, both as to their steps and their constituents, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
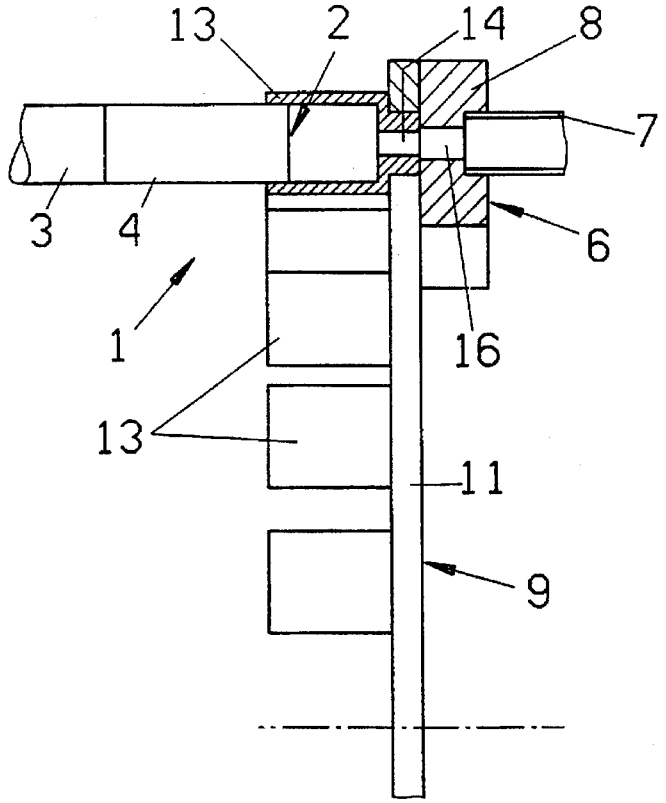
FIG. 1 is a fragmentary sectional view of an apparatus which is designed to pneumatically separate fragments of fibers at the end faces of filter mouthpieces.
Figure 2:
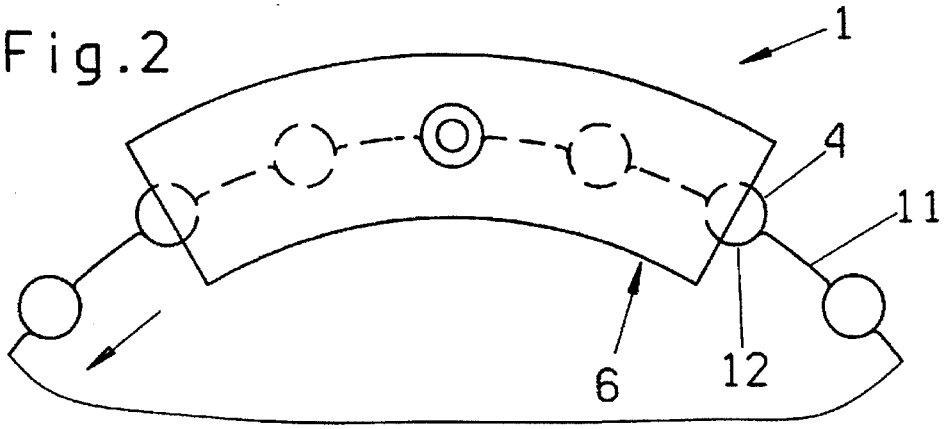
FIG. 2 is a fragmentary end elevational view as seen from the right-hand side of FIG. 1.

FIGS. 1 and 2 show a portion of an apparatus 1 which embodies one form of the present invention. Such apparatus can be incorporated into or combined with a filter cigarette production line of the type known as PROTOS 2, and its filter tipping machine or unit (namely the part wherein plain cigarettes of unit length are or can be assembled with filter rod sections of multiple unit length) can be of the type described and shown in commonly owned U.S. Pat. No. 4,969,551 granted Nov. 13, 1990 to Uwe Heitmann et al. for "Method of and apparatus for rolling rod-shaped articles". The disclosure of this patent is also incorporated herein by reference.

The apparatus 1 of FIGS. 1 and 2 comprises a rotary drum-shaped or wheel-shaped conveyor 11 having axially parallel peripheral flutes 12 for discrete filter cigarettes 3 of unit length. Each such filter cigarette includes a tobbacco-containing rod-shaped component which constitutes a plain cigarette of unit length and a mouthpiece 4 of unit length. The mouthpiece 4 has an end face 2 which develops when a filter rod section of double unit length between two axially aligned plain cigarettes of unit length is severed midway between its ends to thus convert the group of three coaxial rod-shaped components into two filter cigarettes 3 of unit length. All this is fully described in the aforementioned U.S. Pat. No. 4,969,551. The filter mouthpiece 4 contains plastic fibers, such as cellulose acetate fibers, some of which are severed or otherwise comminuted during the making of filter cigarettes of unit length, namely during subdivision of filter rod sections of double unit length into pairs of filter mouthpieces 4 of unit length. At least some such fragments of fibers exhibit a tendency to become separated from the respective mouthpiece 4, either immediately after the making of the end face 2 or thereafter, e.g., during transport to storage (e.g., in the form of a mass flow) or to a packing machine, in storage or in the packing machine, or in the cigarette packets. Such uncontrolled separation of fibers or fragments of fibers is highly undesirable because these particles are likely to contaminate the atmosphere around the filter tipping machine, the packing machine, the conveyor or conveyors for transport of filter cigarettes of unit length and/or the packets for filter cigarettes.

The apparatus 1 of FIGS. 1 and 2 comprises a unit 6 which is designed to intentionally (i.e., controlledly in a planned manner) remove fibers and/or fragments of fibers (if any) which are adjacent the end faces 2 of successive mouthpieces 4 in the flutes 12 of the rotary conveyor 11 and to thus prevent such particles from contaminating the surrounding atmosphere and/or the equipment serving to receive filter cigarettes 3 from the conveyor 11. The unit 6 comprises a stationary shoe 8 which is immediately adjacent the side face 9 of the rotary conveyor 11 and is provided with at least one suction port 16 communicating with the intake end of a suction pipe 7 forming part of a suction generating device such as a fan, a pump or the like. The conveyor 11 carries a circular array of cupped members 13 which receive portions of the filter mouthpieces 4 on the conveyor 11 and define suction chambers adjacent the respective end faces 2. Each cupped meter 13 is further provided with a suction port 14 which communicates with the respective suction chamber, and successive ports 14 advance toward and temporarily communicate wit the stationary suction port 16 to enable the suction generating device including the pipe 7 to evacuate all loose fibers and/or fragments of fibers (if any) from the respective suction chambers, i.e., from the regions at the end faces 2 of successive filter mouthpieces 4 of unit length. The pipe 7 can convey streams of air and fragments of fibers or entire fibers (if any) into the range of a sieve (not shown) or another suitable intercepting device for the conveyed fragments.

The suction chambers of the members 13 are sealed from the atmosphere when such members receive portions of filter mouthpieces 4, and the engagement between the stationary shoe 8 and the side face 9 of the rotary conveyor 11 is also selected with a view to prevent uncontrolled penetration of atmospheric air into the suction pipe 7.

The suction port 16 can constitute an arcuate slot to ensure longer-lasting communication between such port and successive suction ports 14.

The feature that complete fibers and/or fragments of fibers are intentionally separated from successive filter mouthpieces 4 at the end faces of such mouthpieces not only enhances the quality of surrounding air but also enhances the appearance (and hence the quality) of the filter cigarettes 3.

Figure 3:
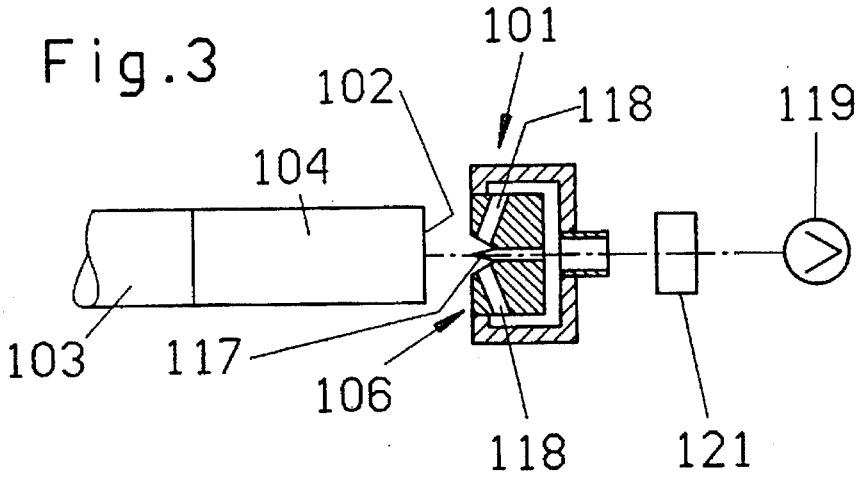
FIG. 3 is a fragmentary sectional view of a modified apparatus which is designed to remove fragments of fibers of filter material by resorting to electrostatic precipitation.

FIG. 3 shows a portion of an apparatus 101 which constitutes a first modification of the apparatus 1. All such parts of the apparatus 101 which are clearly analogous to or identical with the corresponding parts of the apparatus 1 are denoted by similar reference characters plus 100. An advantage of the apparatus 101 is that portions of filter mothpieces 104 forming part of filter cigarettes 103 and having end faces 102 need not be introduced into cupped members 13 of the type shown in FIG. 1. Thus, the conveyor (not specifically shown but corresponding, for example, to the conveyor 11 of FIGS. 1 and 2) for the filter cigarettes 103 can transport such smokers' products past a stationary fiber separating and collecting unit 106 of the apparatus 101 in such a way that the end faces 102 and/or other parts of the mouthpieces 104 need not contact the unit 106. The latter comprises an electrode 117 which serves to generate an electostatic field having a polarity opposite to that of the mouthpieces 104. This suffices to ensure that any fibers and/or fragments of fibers which can be readily separated from the end faces 102 and/or other portions of successive filter mouthpieces 104 are attracted toward the electrode 117 and hence into the range of suction ports 118 provided in the unit 106 and communicating with a suitable suction generating device 119. The latter draws air (and solid impurities, if any) from the ports 118 through a suitable filter 121 wich intercepts and collects the impurities.

Figure 4:
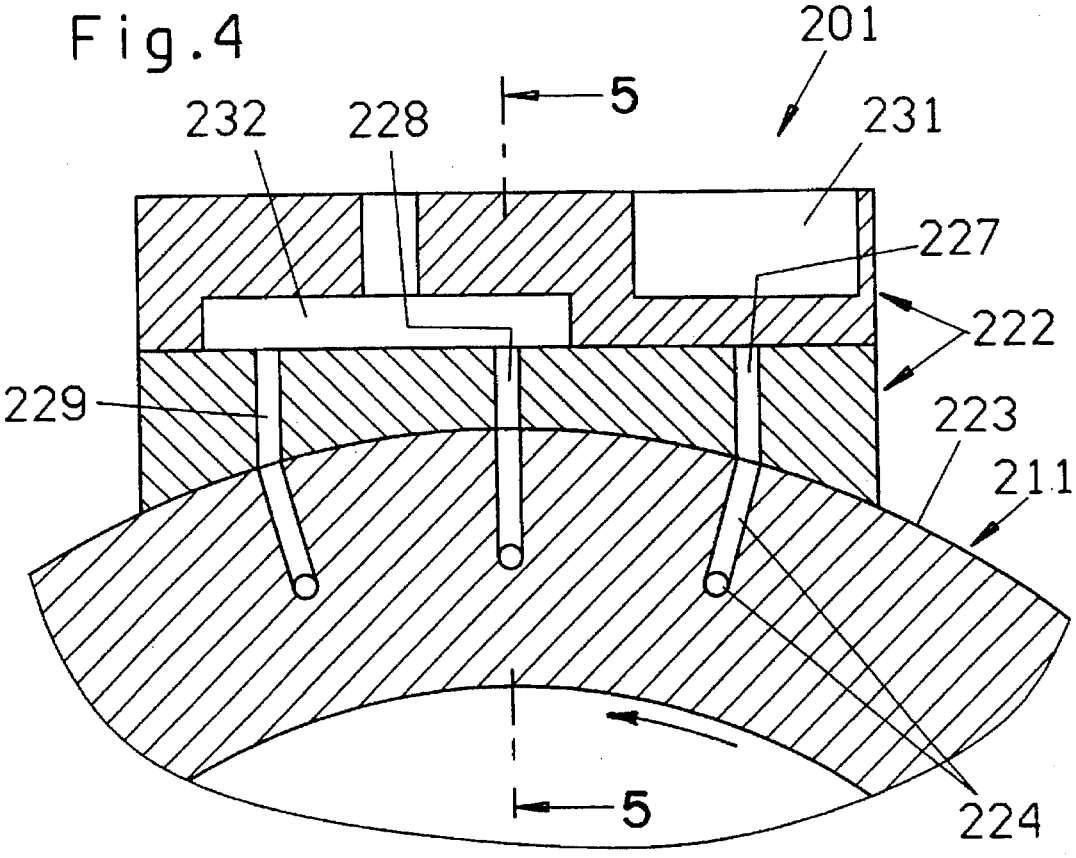
FIG. 4 is a fragmentary sectional view of an apparatus which causes the fragments of fibers to adhere to the respective mouthpieces by resorting to a solvent.
Figure 5:
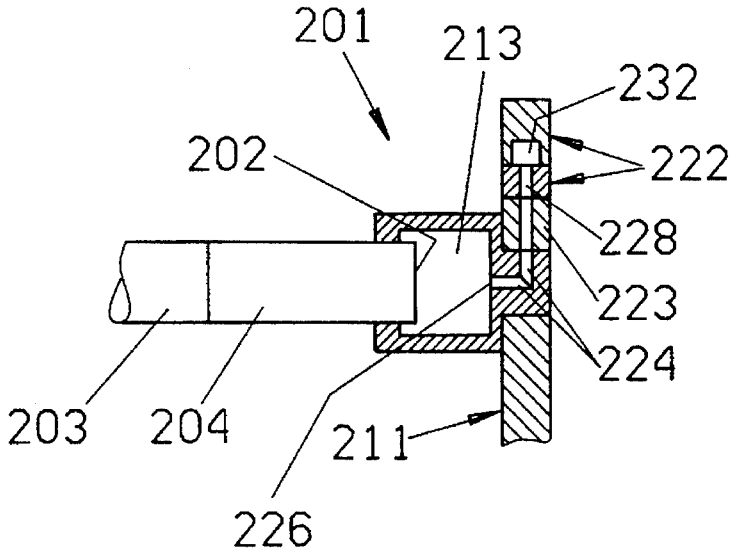
FIG. 5 is a smaller-scale sectional view substantially as seen in the direction of arrows from the line 5—5 in FIG. 4.

All such parts of the apparatus 201 shown in FIGS. 4 and 5 which are identical with or clearly analogous to the corresponding parts of the apparatus 1 of FIGS. 1 and 2 are denoted by similar reference characters plus 200. The apparatus 201 comprrises a rotary conveyor 211 having a ring-shaped peripheral portion 223 with L-shaped bores 224 in communication with the chambers of cupped members 213 each of which receives a portion of a mouthpiece 204 forming part of a filter cigarette 203 of unit length. The end faces 202 are received in the chambers of the respoective cupped members 213. The apparatus 201 further comprises a stationary ring-shaped member 222 which sealingly engages the adjacent side face of the member 223 and is provided with a reservoir 231 for a supply of suitable solvent (such as triacetin) as well as with a plenum chamber 232. The member 222 has a bore 227 which can discharge solvent from the reservoir 231 into successive bores 224, as well as bores 228, 229 which connect the plenum changer 232 with successive pairs of bores 224 when the conveyor 211 is rotated. Each bore 224 has an orifice 226 which can discharge droplets of solvent into the chambers of successive members 213 on the portion 223 of the conveyor. The solvent is compelled to impinge upon successive end faces 202 under the action of jets of compressed air issuing from the bores 228, 229 so that the relatively large droplets of solvent leaving the bore 227 are divided into minute droplets impinging against the entire end faces 202 advancing beyond the bores 228 and 229. The solvent effects localized softening of the fibers at the end faces and the fibers are thus bonded to each other to prevent their separation from the respective mouthpieces 203. Thus, such fibers, as well as their fragments, are secured to the respective mouthpieces 203 and cannot escape into the surrounding atmosphere and/or contaminate the conveyors for filter cigarettes 203, the packing machine and/or the packets for filter cigarettes.

It will be seen that the quality of the filter cigarettes 3, 103 and 203 can be enhanced by resorting to controlled removal of fibers or fragments of fibers which are likely to become separated from the respective mouthpieces (4 or 104), or by ensuring that the fibers and/or their fragments are not permitted to become separated from the respective mouthpieces (204).

Figure 6:
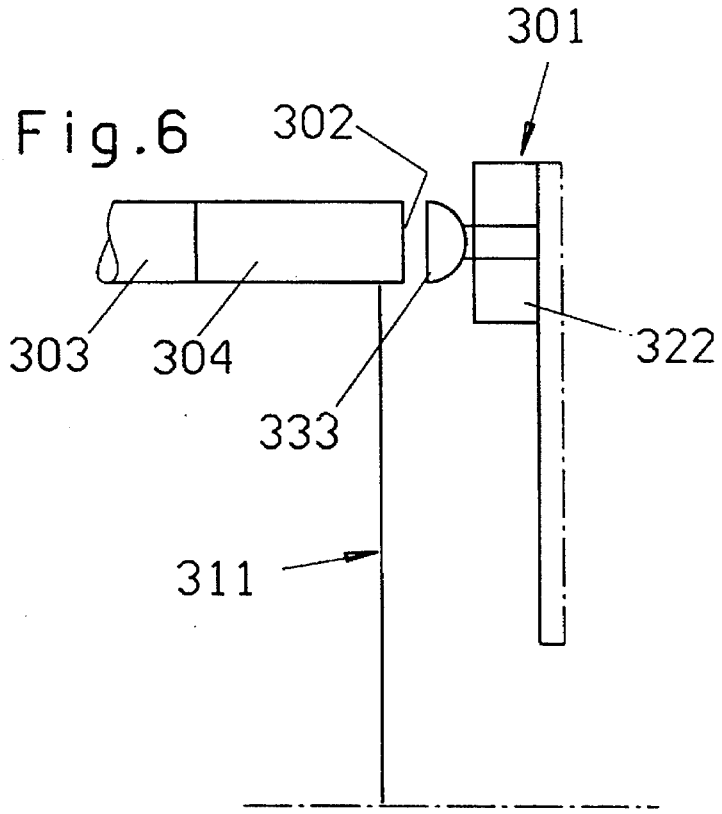
FIG. 6 is a schematic fragmentary view of an apparatus which causes the fragments of fibers to adhere to the respective mouthpieces under the action of heat.

All such parts of the apparatus 301 of FIG. 6 which are identical with or clearly analogous to the corresponding pares in the apparatus 1 of FIGS. 1 and 2 are denoted by similar reference characters plus 300. The unit 322 includes at least one source 333 of heat which softens the fibers along the end faces 302 of mouthpieces 304 forming part of filter cigaretets 303 on the conveyor 311 so that the thus heated fibers at the end faces 302 are softened and adhere to each other not unlike under the action of triacetin or another suitable softener or plasticizer.

It is clear that the features of the apparatus 301 can be combined with those of the apparatus 201 without departing from the spirit of the present invention.

Figure 7:
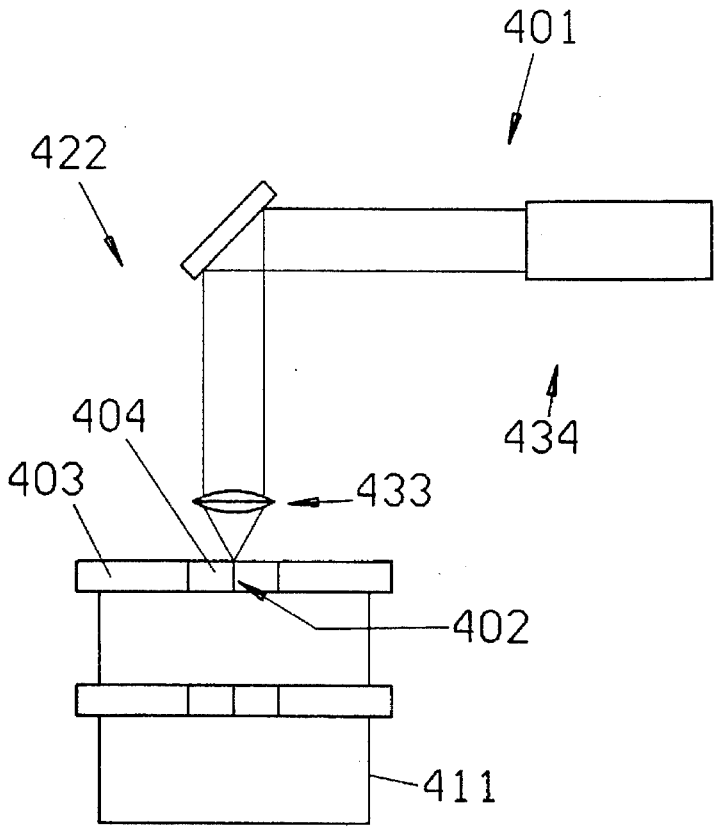
FIG. 7 is a fragmentary partly schematic view of an apparatus wherein the means for severing filter rod sections employs a laser.

All such parts of the apparatus 401 shown in FIG. 7 which are identical with or clearly analogous to the corresponding parts of the apparatus 1 of FIGS. 1 and 2 are denoted by similar reference characters plus 400. The apparatus 401 comprises a combined group severing and filter material heating unt 422 including a cutter 434 employing at least one laser and an optical heater 433 for the fibers at the end faces 402 of filter mouthpieces 404 of unit length which are obtained by subdividing filter mouthpieces of double unit length so that each mouthpiece 404 and the adjacent plain cigarette together constitute a filter cigarette 403 of unit length. The groups each of which includes two plain cigarettes of unit length and a filter mouthpiece of double unit length are severed during travel with the respective axially parallel peripheral flutes of a rotary drum-shaped or ring-shaped or wheel-shaped conveyor 411. The conveyor 411 can be said to correspond to the conveyor 59*a*, and the knife 434 can be said to perform the function of the knife 59, both shown in FIG. 5 of the U.S. Pat. No. 4,969,551.

It will be seen that the improved apparatus 401 is incorporated into a filter tipping machine in such a way that the knife 434 cooperates with the optical element 433 to perform the dual function of severing successive filter rod sections of double unit length (to form pairs of filter mouthpieces 404 of unit length) as well as to perform the function of the heating element 333 shown in FIG. 6, i.e., to prevent uncontrolled separation of fibers and/or fragments of fibers from the end faces 402 of the filter mouthpieces 404. Analogous plural functions can be carried out by other types of knives or cutters, for example, by certain types of flame or torch cutters, without departing from the purview of this invention.

Figure 8:
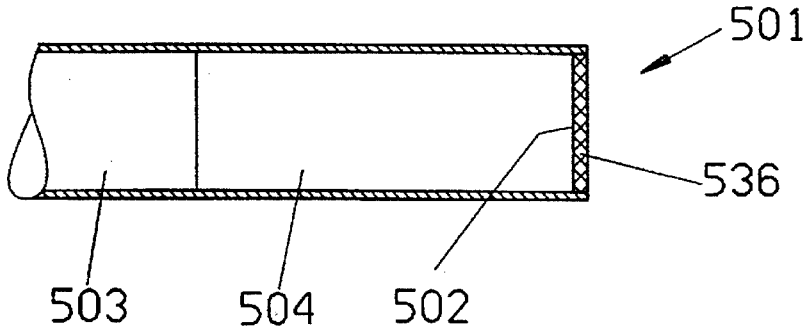
FIG. 8 shows a portion of a filter cigarette wherein the end face of the filter mouthpiece is overlapped by a layer of filter material.

FIG. 8 shows a portion of an apparatus 501 which is designed to prevent uncontrolled separation of fibers and/or fragments of fibers at the end faces 502 of filter mouthpieces 504 forming part of filter cigarettes 503 of unit length by applying suitable layers 536 of gas permeable tobaco smoke filtering material at least over the end faces 502 of successive filter cigarettes 503 on a conveyor (not shown) of the apparats 501. For example, the layers 536 can be made of filter paper which exhibits the requisite porosity so that it does not unduly interfere with the flow of tobacco smoke toward and into the smoker's mouth. The illustrated disc-shaped layer 536 can be replaced with a cupped or analogous part which receives a portion of or even the entire filter mouthpiece 504.

The improved method and apparatus are susceptible of numerous additional modifications. For example, the heating element or elements 333 of FIG. 6 can be replaced with a source of hot air or another gaseous fluid, or can constitute a source of infrared radiation. All that counts is to ensure a heating which entails at least partial melting of those fibers which tend to become separated from the respective filter mouthpieces so that the thus heated fibers or fragments of fibers are fused to the adjacent fibers, namely to the fibers which do not exhibit a tendency to become separated from the respective filter mouthpieces of unit length. In each instance, the controlled separation of fibers or fragments of fibers from the respective mouthpieces and/or the controlled bonding of such fibers or fragments of fibers to the respective mouthpieces should be carried out with a view to ensure that the fibers at the end faces of the mouthpieces do not interfere with the desirable optimum flow of tobacco smoke through and out from the respective end faces.

An important advantage of the improved method and apparatus is that the fibers and/or fragments of fibers which exhibit a tendency to become randomly or uncontrollably separated from the respective mouthpieces are removed in a controlled manner or bonded to the respective mouthpieces as soon as they are free to exhibit such tendency, i.e., as soon as the respective end faces are formed. This greatly reduces the likelihood of contamination of the surrounding area, of the equipment which is used to transport and/or process filter cigarettes of unit length and/or of the packets for arrays of filter cigarettes of unit length. Still further, the improved method and apparatus render it possible to enhance the appearance of the filter cigarettes as well as of the receptacles (such as packets) for arrays of four, five, ten, twenty or more filter cigarettes of unit length.

Without further analysis, the foregoing will so fully reveal the gist of the present invention that others can, by applying current knowledge, readily adapt it for various applications without omitting features that, from the standpoint of prior art, farly constitute essential characteristics of the generic and specific aspects of the above outlined contribution to the art of making rod-shaped smokers' products and, therefore, such adaptations should and are intended to be comprehended within the meaning and range of equivalence of the appended claims.

What is claimed is:

1. A method of processing smokers' products wherein a plurality of aligned rod-shaped components include at least one multiple-unit-length filter rod section containing plastic fibers and a pair of tobacco-containing components flanking the at least one section, comprising the steps of severing the products across their sections so that the severed sections develop pairs of mouthpieces having end faces at which at least some of the fibers tend to become separated from the respective mouthpieces; and preventing uncontrolled separation of fibers from the respective mouthpieces including intentionally removing said at least some fibers from the respective mouthpieces by electrically separating the at least some fibers from the respective mouthpieces.

2. The method of claim 1, wherein said fibers are cellulose acetate fibers.

3. The method of claim 1, wherein said electrically separating step includes separating the at least some fibers from the respective mouthpieces by electrostatic precipitation.

4. Apparatus for processing smokers' products wherein a plurality of aligned rod-shaped components include at least one multiple-unit-length filter rod section containing plastic fibers and a pair of tobacco-containing components flanking the at least one section, comprising means for severing me products across their sections so that the severed sections develop pairs of mouthpieces having end faces; and means for enhancing the quality of said end faces, said quality enhancing means comprising means for establishing electric fields adjacent the end faces of the mouthpieces.

5. The apparatus of claim 4, wherein the filter rod sections contain cellulose acetate fibers at least some of which are comminuted by said severing means.

* * * * *